US006723135B2

(12) United States Patent
Eskuchen et al.

(10) Patent No.: US 6,723,135 B2
(45) Date of Patent: Apr. 20, 2004

(54) LAUNDRY DETERGENTS AND CLEANING PRODUCTS BASED ON ALKYL AND/OR ALKENYL OLIGOGLYCOSIDES AND FATTY ALCOHOLS

(75) Inventors: Rainer Eskuchen, Langenfeld (DE); Ditmar Kischkel, Monheim (DE); Manfred Weuthen, Langenfeld (DE); Michael Koehler, Mettmenn (DE); Werner Leinemann, Ratingen (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 56 days.

(21) Appl. No.: 09/956,176

(22) Filed: Sep. 19, 2001

(65) Prior Publication Data

US 2002/0058602 A1 May 16, 2002

(30) Foreign Application Priority Data

Sep. 19, 2000 (DE) ..... 100 46 251

(51) Int. Cl.[7] ..... D06L 1/00; C11D 1/68; C11D 3/22

(52) U.S. Cl. ..... 8/137; 510/276; 510/342; 510/353; 510/356; 510/470; 510/535

(58) Field of Search ..... 510/276, 342, 510/353, 356, 470, 535; 8/137

(56) References Cited

U.S. PATENT DOCUMENTS

| | | | | |
|---|---|---|---|---|
| 3,966,629 A | | 6/1976 | Dumbrell | |
| 4,062,647 A | | 12/1977 | Storm et al. | |
| 4,524,009 A | | 6/1985 | Valenty | |
| 4,639,325 A | | 1/1987 | Valenty et al. | |
| 4,737,306 A | | 4/1988 | Wichelhaus et al. | |
| 4,816,553 A | | 3/1989 | Baur et al. | |
| 4,820,439 A | | 4/1989 | Rieck | |
| 4,985,553 A | | 1/1991 | Fuertes et al. | |
| 5,002,695 A | | 3/1991 | Schulz et al. | |
| 5,312,932 A | | 5/1994 | Behler et al. | |
| 5,322,957 A | | 6/1994 | Fabry et al. | |
| 5,374,716 A | | 12/1994 | Biermann et al. | |
| 5,417,951 A | | 5/1995 | Just | |
| 5,484,531 A | | 1/1996 | Kuehne et al. | |
| 5,494,488 A | | 2/1996 | Arnoldi et al. | |
| 5,501,814 A | | 3/1996 | Engelskirchen et al. | |
| 5,541,316 A | | 7/1996 | Engelskirchen et al. | |
| 5,576,425 A | | 11/1996 | Hill et al. | |
| 5,631,357 A | | 5/1997 | Weuthen et al. | |
| 5,670,471 A | * | 9/1997 | Amalric et al. | 510/416 |
| 5,672,781 A | | 9/1997 | Koehler et al. | |
| 5,780,420 A | | 7/1998 | Breuer et al. | |
| 5,795,978 A | * | 8/1998 | Ansmann et al. | 536/120 |
| 5,821,360 A | | 10/1998 | Engelskirchen et al. | |
| 5,830,956 A | | 11/1998 | Stockhausen et al. | |
| 5,854,321 A | | 12/1998 | Krause et al. | |
| 5,959,101 A | | 9/1999 | Engelskirchen et al. | |
| 5,981,452 A | * | 11/1999 | Schrader et al. | 510/155 |
| 6,075,001 A | | 6/2000 | Wilde | |
| 6,153,576 A | | 11/2000 | Blum et al. | |
| 6,187,055 B1 | | 2/2001 | Kottwitz et al. | |
| 6,200,946 B1 | | 3/2001 | Blum et al. | |
| 2002/0058602 A1 | * | 5/2002 | Eskuchen et al. | 510/421 |

FOREIGN PATENT DOCUMENTS

| | | |
|---|---|---|
| CA | 981141 | 1/1976 |
| CA | 2158714 | 9/1995 |
| DE | 2 334 899 | 1/1974 |
| DE | 25 53 900 | 6/1977 |
| DE | 35 26 405 | 2/1987 |
| DE | 0 309 931 | 4/1989 |
| DE | 42 04 700 | 8/1993 |
| DE | 42 21 381 | 2/1994 |
| DE | 43 00 772 | 7/1994 |
| DE | 43 03 320 | 8/1994 |
| DE | 44 00 024 | 7/1995 |
| DE | 44 16 438 | 11/1995 |
| DE | 44 17 734 | 11/1995 |
| DE | 44 43 177 | 6/1996 |
| DE | 195 29 905 | 2/1997 |
| DE | 195 36 082 | 4/1997 |
| DE | 196 00 018 | 7/1997 |
| DE | 196 05 688 | 8/1997 |
| DE | 196 13 103 | 10/1997 |
| DE | 196 20 411 | 10/1997 |
| DE | 196 16 693 | 11/1997 |
| DE | 196 16 767 | 11/1997 |
| DE | 196 16 769 | 11/1997 |
| DE | 196 16 770 | 11/1997 |
| DE | 196 20 267 | 11/1997 |
| DE | 197 09 991 | 9/1998 |
| DE | 197 10 254 | 9/1998 |
| EP | 0 026 529 | 4/1981 |

(List continued on next page.)

OTHER PUBLICATIONS

Hill et al., Alkyl Polyglycosides: Technology, Properties and Applications, VCH (1997) (book) 4 pgs, No month given.

Biswas et al., Journal American Oil Chemist's Society, *Surface–Active Properties of Sodium Salts of Sulfated Fatty Acid Monoglycerides*, 37, pp. 171–175 (1960), Apr. 1960.

F. U. Ahmed, Journal American Oil Chemist's Society, *Efficient Synthesis of Fatty Monoglyceride Sulfates from Fatty Acids and Fatty Acid Methyl Esters*, 67, pp. 8–14 (1990), Jan. 1990.

Mackenzie et al., The Analyst, *Differential Thermal Analysis*, 87 pp. 420–434 (1962), Jun. 1962.

Falbe et al., Rompp Chemie Lexikon, 9$^{th}$ Ed., 61(6), p. 4440 (1972), not translated; No month given.

Voight, Lehrbuch der pharmazeutischen Technologie, 6$^{th}$ Ed., pp. 182–184 (1987), Not translated; No month given.

*Primary Examiner*—Brian P. Munk
(74) *Attorney, Agent, or Firm*—John E. Drach; Steven J. Trzaska

(57) ABSTRACT

A laundry detergent composition containing a surfactant system having: (a) an alkyl and/or alkenyl oligoglycoside; (b) from about 5 to 35% by weight of a fatty alcohol; and (c) up to 2% by weight water, all weights being based on the weight of the surfactant system.

14 Claims, No Drawings

FOREIGN PATENT DOCUMENTS

| | | | | |
|---|---|---|---|---|
| EP | 0 028 432 | | 5/1981 | |
| EP | 0 150 930 | | 8/1985 | |
| EP | 0 164 514 | | 12/1985 | |
| EP | 0 232 202 | | 12/1987 | |
| EP | 0 272 030 | | 6/1988 | |
| EP | 0 280 223 | | 8/1988 | |
| EP | 0 301 298 | | 2/1989 | |
| EP | 0 392 592 | | 10/1990 | |
| EP | 0 427 349 | | 5/1991 | |
| EP | 0 458 397 | | 11/1991 | |
| EP | 0 458 398 | | 11/1991 | |
| EP | 0 472 042 | | 2/1992 | |
| EP | 0 496 510 | | 7/1992 | |
| EP | 0 525 239 | | 2/1993 | |
| EP | 0 542 496 | | 5/1993 | |
| EP | 0 544 490 | | 6/1993 | |
| EP | 0 544 519 | | 6/1993 | |
| EP | 0 549 271 | | 6/1993 | |
| EP | 0 549 272 | | 6/1993 | |
| EP | 0 561 999 | | 9/1993 | |
| EP | 0 446 982 | | 10/1994 | |
| EP | 0 453 003 | | 10/1994 | |
| EP | 0 639 049 | | 2/1995 | |
| EP | 0 561 825 | | 9/1995 | |
| EP | 0 443 651 | | 10/1995 | |
| EP | 0 693 550 | | 1/1996 | |
| EP | 0 724 555 | | 8/1996 | |
| EP | 1188816 | * | 9/2001 | ..... C11D/1/825 |
| GB | 94 19 091 | | 9/1995 | |
| JP | 93/339896 | | 12/1993 | |
| WO | WO 90/03977 | | 4/1990 | |
| WO | WO 91/08171 | | 6/1991 | |
| WO | WO 92/18542 | | 10/1992 | |
| WO | WO 93/08251 | | 4/1993 | |
| WO | WO 93/16110 | | 8/1993 | |
| WO | WO 94/22800 | | 10/1994 | |
| WO | WO 94/27970 | | 12/1994 | |
| WO | WO 94/28006 | | 12/1994 | |
| WO | WO 94/28030 | | 12/1994 | |
| WO | WO 94/28102 | | 12/1994 | |
| WO | WO94/28103 | | 12/1994 | |
| WO | WO 95/00626 | | 1/1995 | |
| WO | WO 95/07303 | | 3/1995 | |
| WO | WO 95/12619 | | 5/1995 | |
| WO | WO 95/14075 | | 5/1995 | |
| WO | WO 95/14759 | | 6/1995 | |
| WO | WO 95/17498 | | 6/1995 | |
| WO | WO 95/20029 | | 7/1995 | |
| WO | WO 95/20608 | | 8/1995 | |
| WO | WO 95/27775 | | 10/1995 | |
| WO | WO 98/40462 | | 9/1998 | |
| WO | WO 98/40463 | | 9/1998 | |
| WO | WO 98/55583 | | 12/1998 | |
| WO | WO98/55590 | | 12/1998 | |

* cited by examiner

LAUNDRY DETERGENTS AND CLEANING PRODUCTS BASED ON ALKYL AND/OR ALKENYL OLIGOGLYCOSIDES AND FATTY ALCOHOLS

BACKGROUND OF THE INVENTION

The invention relates to laundry detergents and cleaning products which comprise a surfactant system based on alkyl and/or alkenyl oligoglycosides and fatty alcohols and to its use to boost wash performance at low temperatures.

To date, alkyl and/or alkenyl oligoglycosides have been used in small amounts, in the form of aqueous pastes or as granules with a fatty alcohol content below 1.5%, to formulate laundry detergents and cleaning products. In order to lower the excess of fatty alcohol resulting from the preparation to a level of 1.5% by weight, it is necessary to distill off the alcohol.

The international application WO 94/28006 (Henkel) discloses nonionic emulsifiers containing from 25 to 40% by weight alkyl and/or alkenyl oligoglycosides and from 75 to 60% by weight fatty alcohols particularly for use in haircare and bodycare products.

EP 0 301 298 A1 (Henkel) describes a process for preparing alkyl and/or alkenyl oligoglycosides which involves distilling off the excess fatty alcohol to levels of between 0.5% by weight, preferably 3 to 5% by weight. The reaction product is processed to an easily handled 60% paste by addition of water. Also described are products comprising these alkyl and/or alkenyl oligoglycoside mixtures which have either been freed completely from fatty alcohol, i.e., contain less than 0.5% by weight of fatty alcohol, or else contain from 0.5 to 5%, preferably from 2.5 to 4%, of fatty alcohol by weight.

In contrast to the prior art, the present specification describes laundry detergents and cleaning products, based on a surfactant system comprising alkyl and/or alkenyl oligoglycoside and fatty alcohol in which the fatty alcohol content has been adjusted so as to optimize the wash performance particularly at low wash temperatures, preferably below 40° C.

DESCRIPTION OF THE INVENTION

The subject matter of the main claim is therefore as follows:

laundry detergents and cleaning products comprising a surfactant system composed of at least two components
a. alkyl and/or alkenyl oligoglycosides and
b. fatty alcohol, characterized in that component b is present in amounts of from 5 to 35% by weight, based on active alkyl and/or alkenyl oligoglycoside substance.

The fatty alcohol content (component b) is preferably from 8 to 32% by weight, more preferably from 10 to 30% by weight, in particular from 11 to 25% by weight, based on active alkyl and/or alkenyl oligoglycoside substance. The water content of the mixture of components a and b is, where appropriate, not more than 2% by weight, preferably from 0.1 to 1.5% by weight.

Alkyl and/or Alkenyl Oligoglycosides

To prepare the compositions of the invention it is preferred to use alkyl and/or alkenyl oligoglycosides which conform to the formula (I)

$$R^1O—[G]_p \quad (I)$$

in which $R^1$ is a branched and unbranched alkyl and/or alkenyl radical having from 4 to 22 carbon atoms, G is a sugar radical having 5 or 6 carbon atoms, and p stands for numbers from 1 to 10. They are preferably prepared by reacting glucose or dextrose monohydrate and fatty alcohol in the presence of catalysts.

In this context they may be obtained by relevant processes of preparative organic chemistry. As representatives of the extensive literature, reference may be made here to the documents EP A1 0301298, WO 90/03977 and to "Alkyl Polyglycosides, Technology, Properties and Applications" (K. Hill, VCH 1997).

The alkyl and/or alkenyl oligoglycosides may derive from aldoses and/or ketoses having 5 or 6 carbon atoms, preferably from glucose. The preferred alkyl and/or alkenyl oligoglycosides are therefore alkyl and/or alkenyl oligoglucosides. The index p in the general formula (I) indicates the degree of oligomerization (DP), i.e., the distribution of monoglycosides and oligoglycosides, and stands for a number between 1 and 10. While p in a given compound must always be integral and in this case may adopt in particular the values p=1 to 6, p for a particular alkyl oligoglycoside is an analytically determined arithmetic variable which usually represents a fraction. Preference is given to using alkyl and/or alkenyl oligoglycosides having an average degree of oligomerization p of from 1.1 to 3.0. From a performance standpoint, preference is given to alkyl and/or alkenyl oligoglycosides whose degree of oligomerization is less than 1.7 and is in particular between 1.2 and 1.5.

The alkyl and/or alkenyl radical $R^1$ may derive from primary alcohols having from 4 to 11, preferably from 8 to 10, carbon atoms. Typical examples are butanol, caproyl alcohol, caprylyl alcohol, capryl alcohol, and undecyl alcohol, and their technical-grade mixtures, as obtained, for example, in the hydrogenation of technical-grade fatty acid methyl esters or in the course of the hydrogenation of aldehydes from the Roelen oxo process. Preference is given to alkyl oligoglucosides of chain length $C_8$–$C_{10}$ (DP=1 to 3), which are obtained as the initial fraction during the distillative separation of technical-grade $C_8$–$C_{18}$ coconut fatty alcohol and may have an impurities fraction of less than 6% by weight of $C_{12}$ alcohol, and also alkyl oligoglucosides based on technical-grade $C_{9/II}$ oxo alcohols (DP=1 to 3). The alkyl and/or alkenyl radical $R^1$ may also derive from primary alcohols having from 12 to 22, preferably from 12 to 18, carbon atoms. Typical examples are lauryl alcohol, myristyl alcohol, cetyl alcohol, palmoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol, and their technical-grade mixtures, which may be obtained as described above. Preference is given to alkyl oligoglucosides based on hydrogenated $C_{12/14}$ cocoyl alcohol with a DP of from 1 to 3.

Fatty Alcohols

Another embodiment describes surfactant systems in laundry detergents and cleaning products, characterized in that fatty alcohol of the formula (II)

$$R^1OH \quad (II)$$

are present where $R^1$ is an alkyl and/or alkenyl radical having 4 to 22 carbon atoms, and the hydrocarbon radicals already described for $R^1$ are to be included. It is therefore preferred for the surfactant mixture of the invention to comprise alkyl and/or alkenyl oligoglycoside and fatty alcohol with the same carbon chain cut. The fatty alcohol may be introduced into the compositions, as a result of the process, by way of the alkyl and/or alkenyl oligoglycosides used, or in separate form.

Preference is also given to compositions characterized in that fatty alcohols of the formula (II) and/or fatty alcohols with alkyl and/or alkenyl radicals $R^2$ that are different from $R^1$ are contained. The compositions may therefore comprise fatty alcohols whose carbon chain cut corresponds to that of the alkyl and/or alkenyl oligoglycosides, i.e., which have been introduced, for example, as a result of the process or separately. It is also possible, however, to use any desired fatty alcohols $R^2OH$, different from $R^1OH$, which again may have been introduced as a result of the process by way of the alkyl and/or alkenyl oligoglycosides, or added separately. Also possible are mixtures of different fatty alcohols ($R^1$ and $R^2$) in the surfactant system. It is also noted that the alkyl and/or alkenyl oligoglycosides may be freed by distillation from the preparation-tied fatty alcohol (depletion) and subsequently enriched with another fatty alcohol.

In the text below, $R^2$ is an aliphatic, linear or branched hydrocarbon radical having from 4 to 22 carbon atoms and 0 and/or 1, 2 or 3 double bonds. Typical examples are caproyl alcohol, caprylyl alcohol, 2-ethylhexyl alcohol, capryl alcohol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, linolyl alcohol, linolenyl alcohol, eleostearyl alcohol, arachyl alcohol, gadoleyl alcohol, behenyl alcohol, erucyl alcohol, and brassidyl alcohol, and also their technical-grade mixtures, as obtained, for example, in the high-pressure hydrogenation of technical-grade methyl esters based on fats and oils or aldehydes from the Roelen oxo process and also as a monomer fraction in the dimerization of unsaturated fatty alcohols. Preference is given to technical-grade fatty alcohols having from 12 to 18 carbon atoms, such as coconut, palm, palm kernel or tallow fatty alcohol, for example. Particular preference is given to linear fatty alcohols having from 12 to 16 carbon atoms, in particular having from 12 to 14 carbon atoms.

The alkenyl radical $R^2$ may derive from primary unsaturated alcohols. Typical examples of unsaturated alcohols are undecen-1-ol, lauroleyl alcohol, myristoleyl alcohol, palmitoleyl alcohol, petroselaidyl alcohol, oleyl alcohol, elaidyl alcohol, ricinoleyl alcohol, linoleyl alcohol, linolenyl alcohol, gadoleyl alcohol, arachidonyl alcohol, erucyl alcohol, brassidyl alcohol, palmoleyl alcohol, petroselinyl alcohol, arachyl alcohol, and mixtures thereof and mixtures of unsaturated and saturated fatty alcohols obtained by the processes described in EP 0724 555 B1.

Preference is also given to mixtures of saturated and unsaturated fatty alcohols based on materials found in plants, which are substantially—that is, to the extent of at least 10% by weight—unsaturated and have iodine numbers of from 20 to 130, preferably from 20 to 110, in particular from 20 to 85 and a conjugated ene content of less than 4.5% by weight, preferably 6% by weight.

Depletion

To date, the aim has been for low fatty-alcohol contents in the alkyl and/or alkenyl oligoglycoside mixtures. In order to achieve this, it is necessary to carry out evaporation with a high input of energy, which from an economic standpoint is a negative factor in evaluation of the process. Moreover, it must be borne in mind that the glycosides are temperature-sensitive and so would require a gentle and thus technically complicated separation procedure. Accordingly, higher fatty alcohol contents have an economic advantage.

Depletion to the inventive alcohol content is to be carried out from a technical standpoint taking into account the known fact of the poor temperature stability of sugar surfactants (risk of caramelization). Suitable for this purpose are all types of evaporators which take account of this fact, but preferably thin film evaporators, falling film evaporators or flash evaporators, and—where necessary —any desired combinations of these components. Depletion may then take place in a manner known per se, for example, at temperatures in the range from 110 to 160° C. and reduced pressures of from 0.1 to 10 mbar.

In a further embodiment, preference is given to laundry detergents and cleaning products characterized in that the mixture of components a and b contains not more than 2% by weight, preferably from 0.1 to 1.5% by weight, in particular from 0.2 to 1.2% by weight, of water. Further preference in this context is given to mixtures having viscosities in the range from 10 to 1000, preferably from 50 to 600 [mPas, 110° C.]. Likewise preferred are mixtures which are bleached at temperatures from 60 to 150° C., preferably from 80 to 110° C. Particular preference is given to using mixtures of a and b which combine all of these features.

The viscosity is determined using a rotational viscometer (e.g., Rheomat 115, DIN 145). This viscometer comprises a measuring system having a rotating inner cylinder and a fixed outer cylinder.

In one preferred embodiment, the laundry detergents and cleaning products comprise alkoxylated alkanols, which may be added to the compositions in the form of a mixture with the components a and b or else separately. In this context, the alkoxylated alkanols introduced by way of the mixture may differ from those added separately.

Alkoxylated Alkanols

Preference is given to the use of alkoxylated alkanols of the formula (III) as rheology modifiers. Typical examples thereof are fatty alcohol polyethylene glycol/polypropylene glycol ethers of the formula (III) and, respectively, fatty alcohol polypropylene glycol/polyethylene glycol ethers of the formula (IV).

Fatty Alcohol Polyethylene Glycol/Polypropylene Glycol Ethers

In one preferred embodiment, rheology modifiers employed comprise fatty alcohol polyethylene glycol/polypropylene glycol ethers of the formula (III), with or without end-group capping, $$R^3O(CH_2CH_2O)_n[CH_2(CH_3)CHO]_mR^4 \quad \text{(III)}$$

in which $R^3$ is an alkyl and/or alkylene radical having from 8 to 22 carbon atoms, $R^4$ is H or an alkyl radical having from 1 to 8 carbon atoms, n is a number from 1 to 40, preferably from 1 to 30, in particular from 1 to 15, and m is 0 or a number from 1 to 10.

Fatty Alcohol Polypropylene Glycol/Polyethylene Glycol Ethers

Likewise used with preference as rheology modifiers are fatty alcohol polypropylene glycol/polyethylene glycol ethers of the formula (IV), with or without end-group capping, $$R^5O[CH_2(CH_3)CHO]_q(CH_2CH_2O)_rR^6 \quad \text{(IV)}$$

in which $R^5$ is an alkyl and/or alkylene radical having from 8 to 22 carbon atoms, $R^6$ is H or an alkyl radical having from 1 to 8 carbon atoms, q is a number from 1 to 5, and r is a number from 0 to 15.

In accordance with one preferred embodiment, fatty alcohol polyethylene glycol/polypropylene glycol ethers of the formula (III) in which $R^3$ is an aliphatic, saturated, straight-chain or branched alkyl radical having from 8 to 16 carbon atoms, n is a number from 1 to 10, and m is 0 and $R^4$ is hydrogen are in the process of the invention. These compounds are adducts of from 1 to 10 mol of ethylene oxide with monofunctional alcohols. Suitable alcohols are the above-described alcohols such as fatty alcohols, oxo alcohols and Guerbet alcohols.

Of such alcohol ethoxylates, also suitable are those which have a narrowed homolog distribution.

Further suitable representatives of representatives without end-group capping are those of the formula (III) in which $R^3$ is an aliphatic, saturated, straight-chain or branched alkyl radical having from 8 to 16 carbon atoms, n is a number from 2 to 7, m is a number from 3 to 7, and $R^4$ is hydrogen. These compounds comprise adducts of monofunctional alcohols, of the type described above, alkoxylated first with from 2 to 7 mol of ethylene oxide and then with from 3 to 7 mol of propylene oxide.

Further Alcohols and Alkylene Oxides

In another embodiment, the laundry detergents and cleaning products comprise further alcohols and/or alkylene oxides, preferably ethanol, n-butanol, n-propanol, isopropanol and also mono-, oligo- and polyglycols based on ethylene-, propylene-, butylene-, especially 1,2-propanediol and 1,3-propanediol, and their methyl, ethyl and butyl ethers.

Preference is further given to laundry detergents and cleaning products characterized in that further nonionic surfactants are present selected from the group formed by alkyl and/or alkenyl oligoglycosides (different from those of the invention), further alkoxylated alkanols, hydroxy mixed ethers, fatty acid lower alkyl esters, and amine oxides.

Nonionic Surfactants

Typical examples of nonionic surfactants are fatty alcohol polyglycol ethers, alkylphenol polyglycol ethers, fatty acid polyglycol esters, fatty acid amide polyglycol ethers, fatty amine polyglycol ethers, alkoxylated triglycerides, mixed ethers and mixed formals, alk(en)yl oligoglycosides, fatty acid N-alkyl-glucamides, protein hydrolysates (especially plant products based on wheat), polyol fatty acid esters, sugar esters, sorbitan esters, polysorbates, and amine oxides. Where the nonionic surfactants contain polyglycol ether chains, these chains may have a conventional or, preferably, a narrowed homolog distribution. Preference is given to using alkyl and/or alkenyl oligoglycosides (different from those of the invention), further alkoxylated alkanols, hydroxy mixed ethers, fatty acid lower alkyl esters, and amine oxides.

Hydroxy Mixed Ethers

Hydroxy mixed ethers (HMEs) constitute known nonionic surfactants having an asymmetric ether structure and polyalkylene glycol fractions, which are obtained, for example, by subjecting olefin epoxides to a ring opening reaction with fatty alcohol polyglycol ethers. Corresponding products and their use in the field of the cleaning of hard surfaces is subject matter, for example, of the European patent EP-B1 0639049 and of the international patent application WO 94/22800 (Olin), and of the documents cited therein. Typically following hydroxy mixed ethers of the general formula (V)

$$R_7-\underset{}{\overset{OH}{\overset{|}{CH}}}-CHR^8O(CH_2CHR^9O)_1R^{10} \quad (V)$$

in which $R^7$ is a linear or branched alkyl radical having from 2 to 18, preferably from 10 to 16, carbon atoms, $R^2$ is hydrogen or a linear or branched alkyl radical having from 2 to 18 carbon atoms, R3 is hydrogen or methyl, $R^{10}$ is a linear or branched, alkyl and/or alkenyl radical having from 6 to 22, preferably from 12 to 18, carbon atoms, and e stands for numbers from 1 to 50, preferably from 2 to 25, and in particular from 5 to 15, with the proviso that the sum of the carbon atoms in the radicals $R^7$ and $R^8$ is at least 4 and is preferably from 12 to 18. As is evident from the formula, the HMEs may be ring opening products both of internal olefins ($R^8$ other than hydrogen) or terminal olefins ($R^8$ is hydrogen), the latter being preferred in view of their greater ease of preparation and their more advantageous performance properties. Similarly, the polar moiety of the molecule may be a polyethylene glycol (PE) or a polypropylene glycol (PP) chain; likewise suitable are mixed chains of PE and PP units, in either random or block distribution. Typical examples are ring opening products of 1,2-hexene epoxide, 2,3-hexene epoxide, 1,2-octene epoxide, 2,3-ocetene epoxide, 3,4-octene epoxide, 1,2-decene epoxide, 2,3-decene epoxide, 3,4-decene epoxide, 4,5-decene epoxide, 1,2-dodecene epoxide, 2,3-dodecene epoxide, 3,4-dodecene epoxide, 4,5-dodecene epoxide, 5,6-dodecene epoxide, 1,2-tetradecene epoxide, 2,3-tetradecene epoxide, 3,4-tetradecene epoxide, 4,5-tetradecene epoxide, 5,6-tetradecene epoxide, 6,7-tetradecene epoxide, 1,2-hexadecene epoxide, 2,3-hexadecene epoxide, 3,4-hexadecene epoxide, 4,5-hexadecene epoxide, 5,6-hexadecene epoxide, 6,7-hexadecene epoxide, 7,8-hexadecene epoxide, 1,2-octadecene epoxide, 2,3-octadecene epoxide, 3,4-octadecene epoxide, 4,5-octadecene epoxide, 5,6-octadecene epoxide, 6,7-octadecene epoxide, 7,8-octadecene epoxide and 8,9-octadecene epoxide, and their mixtures with adducts of on average from 1 to 50, preferably from 2 to 25, and in particular from 5 to 15, mol of ethylene oxide and/or from 1 to 10, preferably from 2 to 8, and in particular from 3 to 5, mol of propylene oxide with saturated and/or unsaturated primary alcohols having from 6 to 22, preferably from 12 to 18, carbon atoms, such as caproyl alcohol, caprylyl alcohol, 2-ethylhexyl alcohol, capryl alcohol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, linolyl alcohol, linolenyl alcohol, eleostearyl alcohol, arachyl alcohol, gadoleyl alcohol, behenyl alcohol, erucyl alcohol, and brassidyl alcohol, and also their technical-grade mixtures.

Alkoxylated Fatty Acid Lower Alkyl Esters

Suitable alkoxylated fatty acid lower alkyl esters are surfactants of the formula (VI)

$$R^{11}CO(OCH_2CHR^{12})_sOR^{13} \quad (VI)$$

in which $R^{11}CO$ is a linear or branched, saturated and/or unsaturated acyl radical having from 6 to 22 carbon atoms, $R^{12}$ is hydrogen or methyl, $R^{13}$ is linear or branched alkyl radicals having from 1 to 4 carbon atoms, and s stands for numbers from 1 to 20. Typical examples are the formal insertion products of on average from 1 to 20 and preferably from 5 to 10 mol of ethylene oxide and/or propylene oxide into the methyl, ethyl, propyl, isopropyl, butyl, and tert-butyl esters of caproic acid, caprylic acid, 2-ethylhexanoic acid, capric acid, lauric acid, isotridecanoic acid, myristic acid, palmitic acid, palmoleic acid, stearic acid, isostearic acid, oleic acid, elaidic acid, petroselinic acid, linoleic acid, linolenic acid, eleostearic acid, arachic acid, gadoleic acid, behenic acid, and erucic acid, and also their technical-grade mixtures. The products are normally prepared by inserting the alkylene oxides into the carbonyl ester linkage in the presence of special catalysts, such as calcined hydrotalcite, for example. Particular preference is given to reaction products of on average from 5 to 10 mol of ethylene oxide into the ester linkage of technical-grade coconut fatty acid methyl esters.

Amine Oxides

As amine oxides it is possible to use compounds of the formula (VII) and/or.

(VII)

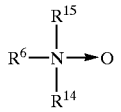

(VIII)

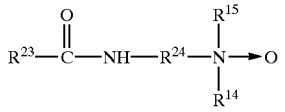

The preparation of the amine oxides of the formula (VII) involves starting from tertiary fatty amines containing at least one long alkyl radical and oxidizing them in the presence of hydrogen peroxide. In the amine oxides of the formula (VII) that are contemplated in the context of the invention, R16 is a linear or branched alkyl radical having from 6 to 22, preferably from 12 to 18, carbon atoms, and also $R^{14}$ and $R^{15}$ independently of one another are $R^{16}$ or an optionally hydroxy-substituted alkyl radical having from 1 to 4 carbon atoms. It is preferred to use amine oxides of the formula (VII) in which $R^{16}$ and $R^{14}$ are $C_{12/14}$ and/or $C_{12/18}$ cocoalkyl radicals and $R^{15}$ is a methyl or a hydroxyethyl radical. Likewise preferred are amine oxides of the formula (VII) in which $R^{16}$ is a $C_{12/14}$ and/or $C_{12/18}$ cocoalkyl radical and $R^{14}$ and $R^{15}$ have the meaning of a methyl or hydroxyethyl radical.

Further suitable amine oxides are alkylamido-amine oxides of the formula (VIII), in which the alkylamido radical $R^{23}CONH$ comes about through the reaction of linear or branched carboxylic acids, preferably having from 6 to 22, more preferably having from 12 to 18, carbon atoms, in particular of $C_{12/14}$ and/or $C_{12/18}$ fatty acids with amines. $R^{24}$ represents a linear or branched alkylene group having from 2 to 6, preferably from 2 to 4, carbon atoms and $R^{14}$ and $R^{15}$ have the definition indicated in formula (VII).

Preference is given, moreover, to laundry detergents and cleaning products characterized in that they comprise anionic surfactants selected from the group formed by alkyl and/or alkenyl sulfates, alkyl ether sulfates, alkylbenzenesulfonates, soaps, monoglyceride (ether) sulfates, and alkanesulfonates.

Anionic Surfactants

Typical examples of anionic surfactants are soaps, alkylbenzenesulfonates, secondary alkanesulfonates, olefinsulfonates, alkyl ether sulfonates, glycerol ether sulfonates, α-methyl ester sulfonates, sulfo fatty acids, alkyl and/or alkenyl sulfates, alkyl ether sulfates, glycerol ether sulfates, hydroxy-mixed ether sulfates, monoglyceride (ether) sulfates, fatty acid amide (ether) sulfates, mono- and dialkyl sulfo-succinates mono- and dialkyl sulfosuccinamates, sulfo-triglycerides amide soaps, ether carboxylic acids and salts thereof, fatty acid isethionates, fatty acid sarcosinates, fatty acid taurides, N-acyl amino acids such as, for example, acyl lactylates, acyl tartrates, acyl glutamates and acyl aspartates, alkyl oligoglucoside sulfates, protein fatty acid condensates (especially plant products based on wheat), and alkyl (ether) phosphates. Where the anionic surfactants contain polyglycol ether chains, these chains may have a conventional or, preferably, a narrowed homolog distribution.

Preferred anionic surfactants are alkyl and/or alkenyl sulfates, alkyl ether sulfates, alkylbenzenesulfonates, monoglyceride (ether) sulfates and secondary alkanesulfonates, especially fatty alcohol sulfates, fatty alcohol ether sulfates, secondary alkanesulfonates, and linear alkylbenzenesulfonates.

Alkyl and/or Alkenyl Sulfates

Alkyl and/or alkenyl sulfates, frequently also referred to as fatty alcohol sulfates, are the sulfation products of primary alcohols, conforming to the formula (IX)

$$R^{40}O—SO_3X \quad (IX)$$

in which $R^{40}$ is a linear or branched, aliphatic alkyl and/or alkenyl radical having from 6 to 22, preferably from 12 to 18, carbon atoms, and X is an alkali metal and/or alkaline earth metal, ammonium, alkylammonium, alkanolammonium or glucammonium.

Typical examples of alkyl sulfates that may be used in the context of the invention are the sulfation products of caproyl alcohol, caprylyl alcohol, capryl alcohol, 2-ethylhexyl alcohol, lauryl alcohol, myristyl alcohol, cetyl alcohol, palmoleyl alcohol, stearyl alcohol, isostearyl alcohol, oleyl alcohol, elaidyl alcohol, petroselinyl alcohol, arachyl alcohol, gadoleyl alcohol, behenyl alcohol, and erucyl alcohol, and also their technical-grade mixtures obtained by high-pressure hydrogenation of industrial methyl ester fractions or aldehydes from the Roelen oxo process. The sulfation products may be used preferably in the form of their alkali metal salts and in particular of their sodium salts. Particular preference is given to alkyl sulfates based on $C_{16/18}$ tallow fatty alcohols or vegetable fatty alcohols of comparable carbon chain distribution in the form of their sodium salts.

Alkyl Ether Sulfates

Alkyl ether sulfates ("ether sulfates") constitute known anionic surfactants which are prepared industrially by $SO_3$ or chlorosulfonic acid (CSA) sulfation of fatty alcohol or oxo alcohol polyglycol ethers and subsequent neutralization. Ether sulfates suitable in the context of the invention are those which conform to the formula (X)

$$R^{17}O—(CH_2CH_2O)_aSO_3X \quad (X)$$

in which $R^{17}$ is a linear or branched alkyl and/or alkenyl radical having from 6 to 22 carbon atoms, a stands for numbers from 1 to 10, and X is an alkali metal and/or alkaline earth metal, ammonium, alkylammonium, alkanolammonium or glucammonium. Typical examples are the sulfates of adducts of on average from 1 to 10 and in particular from 2 to 5 mol of ethylene oxide with caproyl alcohol, caprylyl alcohol, 2-ethylhexyl alcohol, capryl alcohol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, and brassidyl alcohol, and also their technical-grade mixtures in the form of their sodium and/or magnesium salts. The ether sulfates may have either a conventional or a narrowed homolog distribution. Particularly preferred is the use of ether sulfates based on adducts of on average from 2 to 3 mol of ethylene oxide with technical-grade $C_{12/14}$ and/or $C_{12/18}$ coconut fatty alcohol fractions in the form of their sodium and/or magnesium salts.

Alkylbenzenesulfonates

Alkylbenzenesulfonates conform preferably to the formula (XI)

$$R^{18}—Ph—SO_3X \quad (XI)$$

in which $R^{18}$ is a branched or, preferably, linear alkyl radical having from 10 to 18 carbon atoms, Ph is a phenyl radical, and X is an alkali metal and/or alkaline earth metal, ammonium, alkylammonium, alkanolammonium or glucammonium. Preference is given to using dodecylbenzenesulfonates, tetradecylbenzenesulfonates, hexadecylbenzenesulfonates, and their technical-grade mixtures in the form of the sodium salts.

Monoglyceride (Ether) Sulfates

Monoglyceride sulfates and monoglyceride ether sulfates constitute known anionic surfactants which may be obtained in accordance with the relevant methods of preparative organic chemistry. They are usually prepared starting from triglycerides, which immediately or following ethoxylation are transesterified to the monoglycerides and subsequently sulfated and neutralized. It is likewise possible to react the partial glycerides with suitable sulfating agents, preferably gaseous sulfur trioxide or chlorosulfonic acid [cf. EP 0561825 B1, EP 0561999 B1 (Henkel)]. The neutralized substances may, if desired, be subjected to ultrafiltration in order to reduce the electrolyte content to a desired level [DE 4204700 A1 (Henkel)]. Reviews of the chemistry of the monoglyceride sulfates have appeared, for example, by A. K. Biswas et al. in J. Am. Oil. Chem. Soc. 37, 171 (1960) and F. U. Ahmed J. Am. Oil. Chem. Soc. 67, 8 (1990). The monoglyceride (ether) sulfates for use in the context of the invention conform to the formula (XI)

$$\begin{array}{l} CH_2O(CH_2CH_2O)_c—COR^{19} \\ | \\ CH—O(CH_2CH_2O)_dH \\ | \\ CH_2O(CH_2CH_2O)_e—SO_3X \end{array} \quad (XII)$$

in which $R^{19}CO$ is a linear or branched acyl radical having from 6 to 22 carbon atoms, c, d and e in total stand for 0 or for numbers from 1 to 30, preferably from 2 to 10, and X is an alkali metal or alkaline earth metal. Typical examples of monoglyceride (ether) sulfates suitable in the context of the invention are the reaction products of lauric monoglyceride, coconut fatty acid monoglyceride, palmitic monoglyceride, stearic monoglyceride, oleic monoglyceride and tallow fatty acid monoglyceride, and also their ethylene oxide adducts with sulfur trioxide or chlorosulfonic acid in the form of their sodium salts. It is preferred to use monoglyceride sulfates of the formula (XII) in which $R^{19}CO$ is a linear acyl radical having from 8 to 18 carbon atoms.

Secondary Alkanesulfonates

By alkanesulfonates are meant compounds of the formula (XIII).

$$\begin{array}{l} R^{20}—CH—R^{21} \\ \quad\quad | \\ \quad\quad SO_3H \end{array} \quad (XIII)$$

$R^{20}$ and $R^{21}$ are alkyl radicals, and $R^{20}$ and $R^{21}$ together should have not more than 50 carbon atoms.

Soaps

By soaps, finally, are meant fatty acid salts of the formula (XIV)

$$R^{41}CO—OX \quad (XIV)$$

in which $R^{41}CO$ is a linear or branched, saturated or unsaturated acyl radical having from 2 to 22 and preferably from 12 to 18 carbon atoms, and X is alkali metal and/or alkaline earth metal, ammonium, alkylammonium or alkanolammonium. Typical examples are the sodium, potassium, magnesium, ammonium, and triethanolammonium salts of caproic acid, caprylic acid, 2-ethyl-hexanoic acid, capric acid, lauric acid, isotridecanoic acid, myristic acid, palmitic acid, palmoleic acid, stearic acid, isostearic acid, oleic acid, elaidic acid, petroselinic acid, linoleic acid, linolenic acid, elaeostearic acid, arachic acid, gadoleic acid, behenic acid, and erucic acid, and also their technical-grade mixtures. Preference is given to using coconut or palm kernel fatty acid in the form of their sodium or potassium salts.

In a further embodiment, laundry detergents and cleaning products are described which are characterized in that they comprise cationic, amphoteric and/or zitterionic surfactants selected from the group formed by ester quats, alkyl betaines, amidoamine betaines, and imidazolinium betaines.

Cationic Surfactants

Typical examples of cationic surfactants are, in particular, tetraalkylammonium compounds, such as, for example, dimethyldistearylammonium chloride or Hydroxyethyl Hydroxycetyl Dimmonium Chloride (Dehyquart E) or else ester quats. These comprise, for example, quaternized fatty acid triethanol amine ester salts of the formula (XV)

$$\begin{array}{l} \quad\quad\quad\quad\quad\quad\quad\quad\quad\quad R^{46} \\ \quad\quad\quad\quad\quad\quad\quad\quad\quad\quad | \\ [R^{44}CO-(OCH_2CH_2)_{m1}OCH_2CH_2-N^+-CH_2CH_2O-(CH_2CH_2O)_{m2}R^{45}]Y^- \\ \quad\quad\quad\quad\quad\quad\quad\quad\quad\quad | \\ \quad\quad\quad\quad\quad\quad\quad\quad\quad\quad CH_2CH_2O(CH_2CH_2O)_{m3}R^{47} \end{array} \quad (XV)$$

in which $R^{44}CO$ is an acyl radical having from 6 to 22 carbon atoms, $R^{45}$ and $R^{46}$ independently of one another are hydrogen or $R^{14}CO$, $R^{15}$ is an alkyl radical having from 1 to 4 carbon atoms or a $(CH_2CH_2O)_{m4}H$ group, m1, m2 and m3 in total stand for 0 or numbers from 1 to 12, m4 stands for numbers from 1 to 12, and Y is halide, alkyl sulfate or alkyl phosphate. Typical examples of ester quats which may be used in the context of the invention are products based on caproic acid, caprylic acid, capric acid, lauric acid, myristic acid, palmitic acid, isostearic acid, stearic acid, oleic acid, elaidic acid, arachic acid, behenic acid, and erucic acid, and also their technical-grade mixtures as produced, for example, in the pressure cracking of natural fats and oils. Preference is given to using technical-grade $C_{12/18}$ coconut fatty acids and especially partially hydrogenated $C_{16/18}$ tallow and/or palm fatty acids and also $C_{16/18}$ fatty acid cuts rich in elaidic acid. For preparing the quaternized esters, the fatty acids and the triethanolamine may be used in a molar ratio of from 1.1:1 to 3:1. In view of the performance properties of the ester quats, a ratio of from 1.2:1 to 2.2:1, preferably from 1.5:1 to 1.9:1, has proven particularly advantageous. The preferred ester quats constitute technical-grade mixtures of monoesters, diesters and triesters with an average degree of esterification of from 1.5 to 1.9 and derive from technical-grade $C_{16/18}$ tallow and/or palm fatty acid (iodine number from 0 to 40). From a performance standpoint, quaternized fatty acid triethanolamine ester salts of the formula (VIII) have proven particularly advantageous in which $R^{44}CO$ is an acyl radical having from 16 to 18 carbon atoms, $R^{45}$ is $R^{45}CO$, $R^{46}$ is hydrogen, $R^{17}$ is a methyl group, m1, m2, and m3 stand for 0, and Y is methyl sulfate.

Besides the quaternized fatty acid triethanolamine ester salts, further suitable ester quats include quaternized ester salts of fatty acids with diethanolalkylamines of the formula (XVI)

(XVI)

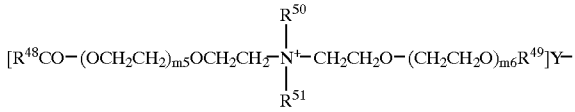

in which $R^{48}CO$ is an acyl radical having from 6 to 22 carbon atoms, $R^{49}$ is hydrogen or $R^{48}CO$, $R^{50}$ and $R^{51}$ independently of one another are alkyl radicals having from 1 to 4 carbon atoms, m5 and m6 in total stand for 0 or numbers from 1 to 12, and Y again is halide, alkyl sulfate or alkyl phosphate.

As a further group of suitable ester quats, finally, mention may be made of the quaternized ester salts of fatty acids with 1,2-dihydroxypropyldialkylamines of the formula (XVII)

(XVII)

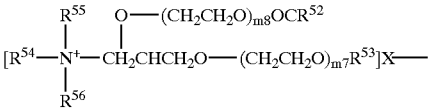

in which $R^{52}CO$ is an acyl radical having from 6 to 22 carbon atoms, $R^{53}$ is hydrogen or $R^{52}CO$, $R^{54}$, $R^{55}$, and $R^{56}$ independently of one another are alkyl radicals having from 1 to 4 carbon atoms, m7 and m8 in total stand for 0 or numbers from 1 to 12, and X again is halide, alkyl sulfate or alkyl phosphate.

Finally, suitable ester quats further include substances in which the ester linkage has been replaced by an amide linkage and which preferably, based on diethylenetriamine, conform to the formula (XVIII)

(XVIII)

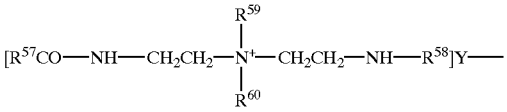

in which $R^{57}CO$ is an acyl radical having from 6 to 22 carbon atoms, $R^{58}$ is hydrogen or $R^{57}CO$, $R^{59}$ and $R^{60}$ independently of one another are alkyl radicals having from 1 to 4 carbon atoms, and Y again is halide, alkyl sulfate or alkyl phosphate. Amide ester quats of this kind are available on the market under the brand name INCROQUAT® (Croda), for example.

Amphotheric or Zwitterionic Surfactants

Examples of suitable amphoteric or zwitterionic surfactants are alkyl betaines, alkylamido betaines, aminopropionates, aminoglycinates, imidazolinium betaines, and sulfo betaines. Examples of suitable alkyl betaines are the carboxyalkylation products of secondary and especially tertiary amines which conform to the formula (XII)

(XIX)

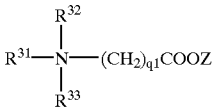

in which $R^{31}$ stands for alkyl and/or alkenyl radicals having from 6 to 22 carbon atoms, $R^{32}$ stands for hydrogen or alkyl radicals having from 1 to 4 carbon atoms, $R^{33}$ stands for alkyl radicals having from 1 to 4 carbon atoms, q1 stands for numbers from 1 to 6, and Z is an alkali metal and/or alkaline earth metal or ammonium. Typical examples are the carboxymethylation products of hexamethylamine, hexyldimethylamine, octyldimethylamine, decyldimethylamine, dodecylmethylamine, dodecyldimethylamine, dodecylethylmethylamine, $C_{12/14}$ cocoalkyldimethylamine, myristyldimethylamine, cetyldimethylamine, stearyldimethylamine, stearylethylmethylamine, oleyldimethylamine, $C_{16/18}$ tallow alkyldimethylamine, and also their technical-grade mixtures.

Also suitable are carboxyalkylation products of amidoamines which conform to the formula (XX)

(XX)

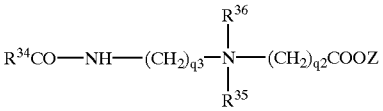

in which $R^{34}CO$ is an aliphatic acyl radical having from 6 to 22 carbon atoms and 0 or from 1 to 3 double bonds, $R^{35}$ stands for hydrogen or alkyl radicals having 1 to 4 carbon atoms, $R^{36}$ stands for alkyl radicals having from 1 to 4 carbon atoms, q2 stands for numbers from 1 to 6, q3 stands for numbers from 1 to 3, and Z again is an alkali metal and/or alkaline earth metal or ammonium. Typical examples are reaction products of fatty acids having from 6 to 22 carbon atoms, namely caproic acid, caprylic acid, capric acid, lauric acid, myristic acid, palmitic acid, palmoleic acid, stearic acid, isostearic acid, oleic acid, elaidic acid, petroselinic acid, linoleic acid, linolenic acid, eleostearic acid, arachic acid, gadoleic acid, behenic acid, and erucic acid, and also their technical-grade mixtures, with N,N-dimethylaminoethylamine, N,N-dimethylaminopropylamine, N,N-diethylaminoethylamine, and N,N-diethylaminopropylamine, these products being condensed with sodium chloroacetate. Preference is given to the use of a condensation product of $C_{8/18}$ coconut fatty acid N,N-dimethylaminopropyl amide with sodium chloroacetate.

Also suitable, furthermore, are imidazolinium betaines. These substances are also known substances, which may be obtained, for example, by cyclizing condensation of 1 or 2 mol of fatty acid with polyfunctional amines such as aminoethylethanolamine (AEEA) or diethylenetriamine, for example. The corresponding carboxyalkylation products are mixtures of different open-chain betaines. Typical examples are condensation products of the abovementioned fatty acids with AEEA, preferably imidazolines based on lauric acid or again $C_{12/14}$ coconut fatty acid, which are subsequently betainized with sodium chloroacetate.

The laundry detergents may comprise the anionic, nonionic and/or amphoteric or zwitterionic surfactants in amounts of from 0.5 to 50, preferably from 5 to 25, and in particular from 10 to 20% by weight, based on the laundry detergents.

The laundry detergents and cleaning products contain from 0.5 to 25% by weight, preferably from 1 to 15% by weight, in particular from 2 to 10% by weight of alkyl and/or alkenyl oligoglycosides, based on active substance of the formulation.

The invention further provides for the use of a mixture of components a and b in laundry detergents and cleaning products for boosting the wash performance at low temperatures, preferably at from 30 to 40° C. The laundry detergents and cleaning products may be present in a variety of forms.

Preference is given in this context to the use of the components a and b in laundry detergents and cleaning products which are in tablet, powder, liquid or gel form.

The laundry detergents and cleaning products may be prepared by spray drying and addition of a liquid or solid, fatty-alcohol-containing alkyl and/or alkenyl oligoglycoside to the preparation, but also by spray mixing processes and direct addition to the liquid or solid mixture. As already described, it is possible, among other things, for the fatty alcohol to be incorporated separately into the laundry detergent and cleaning product. In addition, all known processes for preparing the laundry detergents and cleaning products are possible.

Further Laundry Detergent Additives

Builders

The laundry detergents and cleaning products of the invention may further comprise additional organic and inorganic builder substances in amounts, for example, of from 10 to 50 and preferably from 15 to 35% by weight, based on the compositions, with inorganic builder substances employed comprising primarily zeolites crystalline phyllosilicates, amorphous silicates and—where permissible—also phosphates, such as tripolyphosphate, for example. The amount of cobuilder should be included in the preferred amounts of zeolite and phosphates.

The finely crystalline, synthetic zeolite frequently used as a laundry detergent builder, containing bound water, is preferably zeolite A and/or P. An example of a particularly preferred zeolite P is zeolite MAP® (commercial product from Crosfield). Also suitable, however, are zeolite X and also mixtures of A, X and/or P and also Y. Also of particular interest is a cocrystallized sodium/potassium aluminum silicate comprising a zeolite A and zeolite X, which is available commercially as VEGOBOND AX® (commercial product from Condea Augusta S.p.A.). The zeolite may be employed in the form of spray-dried powder or else as an undried (still wet from its preparation), stabilized suspension. Where the zeolite is used in suspension form, said suspension may include small additions of nonionic surfactants as stabilizers: for example, from 1 to 3% by weight, based on zeolite, of ethoxylated $C_{12}$–$C_{18}$ fatty alcohols having from 2 to 5 ethylene oxide groups, $C_{12}$–$C_{14}$ fatty alcohols having from 4 to 5 ethylene oxide groups or ethoxylated isotridecanols. Suitable zeolites have an average particle size of less than 10 $\mu$m (volume distribution; measurement method: Coulter counter) and contain preferably from 18 to 22% by weight, in particular from 20 to 22% by weight, of bound water.

Suitable substitutes or partial substitutes for phosphates and zeolites are crystalline, layered sodium silicates of the general formula $NaMSi_xO_{2x+1}.yH_2O$, where M is sodium or hydrogen, x is a number from 1.9 to 4, y is a number from 0 to 20, and preferred values for x are 2, 3 or 4. Crystalline phyllosilicates of this kind are described, for example, in the European patent application EP 0164514 A1. Preferred crystalline phyllosilicates of the formula indicated are those in which M is sodium and x adopts the value 2 or 3. In particular, both β- and δ-sodium disilicates $Na_2Si_2O_5.yH_2O$ are preferred, β-sodium disilicate, for example, being obtainable by the process described in the international patent application WO 91/08171. Further suitable phyllosilicates are known, for example, from the patent applications DE 2334899 A1, EP 0026529 A1 and DE 3526405 A1. Their usefulness is not restricted to a specific composition or structural formula. However, preference is given here to smectites, especially bentonites. Suitable phyllosilicates which belong to the group of the water-swellable smectites include, for example, those of the general formulae $(OH)_4Si_{8-y}Al_y(Mg_xAl_{4-x})O_{20}$ montmorillonite $(OH)_4Si_{8-y}Al_y(Mg_{6-z}Li_z)O_{20}$ hectorite $(OH)_4Si_{8-y}Al_y(Mg_{6-z}Al_z)O_{20}$ saponite where x=0 to 4, y=0 to 2, z=0 to 6. Moreover, small amounts of iron may be incorporated into the crystal lattice of the phyllosilicates in accordance with the above formulae. Moreover, on the basis of their ion exchange properties, the phyllosilicates may contain hydrogen, alkali metal and/or alkaline earth metal ions, especially $Na^+$ and $Ca^{2+}$. The amount of water in hydrate form is generally in the range from 8 to 20% by weight and is dependent on the state of swelling and/or on the nature of processing. Phyllosilicates which can be used are known, for example, from U.S. Pat. No. 3,966,629, U.S. Pat. No. 4,062,647, EP 0026529 A1 and EP 0028432 A1. It is preferred to use phyllosilicates which owing to an alkali treatment are substantially free of calcium ions and strongly coloring iron ions.

The preferred builder substances also include amorphous sodium silicates having an $Na_2O:SiO_2$ modulus of from 1:2 to 1:3.3, preferably from 1:2 to 1:2.8, and in particular from 1:2 to 1:2.6, which are dissolution-retarded and have secondary washing properties. The retardation of dissolution relative to conventional amorphous sodium silicates may have been brought about in a variety of ways, for example, by surface treatment, compounding, compacting, or overdrying. In the context of this invention, the term "amorphous" also embraces "X-ray-amorphous". This means that, in X-ray diffraction experiments, the silicates do not yield the sharp X-ray reflections typical of crystalline substances but instead yield at best one or more maxima of the scattered X-radiation, having a width of several degree units of the diffraction angle. However, good builder properties may result, even particularly good builder properties, if the silicate particles in electron diffraction experiments yield vague or even sharp diffraction maxima. The interpretation of this is that the products have microcrystalline regions with a size of from 10 to several hundred nm, values up to max. 50 nm and in particular up to max. 20 nm being preferred. So-called X-ray-amorphous silicates of this kind, which likewise possess retarded dissolution relative to the conventional waterglasses, are described, for example, in the German patent application DE 4400024 A1. Particular preference is given to compact amorphous silicates, compounded amorphous silicates, and overdried X-ray-amorphous silicates.

It is of course also possible to use the widely known phosphates as builder substances, provided such a use is not to be avoided on ecological grounds. Particularly suitable phosphates are the sodium salts of the orthophosphates, of the pyrophosphates and, in particular, of the tripolyphosphates. Their amount should generally be not more than 25% by weight, preferably not more than 20% by weight, based in each case on the finished composition. In certain cases it has been found that tripolyphosphates in particular, even in small amounts up to not more than 10% by weight, based on the finished composition, lead in combination with other builder substances to a synergistic improvement in the secondary detergency.

Cobuilders

Useful organic builder substances suitable as cobuilders are, for example, the polycarboxylic acids, which can be used in the form of their sodium salts, such as citric acid, adipic acid, succinic acid, glutaric acid, tartaric acid, sugar acids, amino carboxylic acids, nitrilotriacetic acid (NTA), provided such use is not objectionable on ecological grounds, and also mixtures of these. Preferred salts are the salts of the polycarboxylic acids such as citric acid, adipic acid, succinic acid, glutaric acid, tartaric acid, sugar acids, and mixtures thereof. The acids per se may also be used. In addition to their builder effect, the acids typically also possess the property of an acidifying component and thus also serve to establish a lower and milder pH of laundry detergents or cleaning products. In this context, mention may be made in particular of citric acid, succinic acid, glutaric acid, adipic acid, gluconic acid, and any desired mixtures thereof.

Further suitable organic builder substances are dextrins, examples being oligomers and polymers of carbohydrates, which may be obtained by partial hydrolysis of starches. The hydrolysis may be conducted by customary processes, examples being acid-catalyzed or enzyme-catalyzed processes. The hydrolysis products preferably have average molar masses in the range from 400 to 500000. Preference is given here to a polysaccharide having a dextrose equivalent (DE) in the range from 0.5 to 40, in particular from 2 to 30, DE being a common measure of the reducing effect of a polysaccharide in comparison to dextrose, which possesses a DE of 100. It is possible to use both maltodextrins having a DE of between 3 and 20 and dry glucose syrups having a DE of between 20 and 37, and also so-called yellow dextrins and white dextrins having higher molar masses, in the range from 2000 to 30000. One preferred dextrin is described in the British patent application GB 9419091 A1. The oxidized derivatives of such dextrins comprise their products of reaction with oxidizing agents which are able to oxidize at least one alcohol function of the saccharide ring to the carboxylic acid function. Oxidized dextrins of this kind, and processes for preparing them, are known, for example, from the European patent applications EP 0232202 A1, EP 0427349 A1, EP 0472042 A1 and EP 0542496 A1 and from the international patent applications WO 92/18542, WO 93/08251, WO 93/16110, WO 94/28030, WO 95/07303, WO 95/12619 and WO 95/20608. Likewise suitable is an oxidized oligosaccharide in accordance with the German patent application DE 19600018 A1. A product oxidized at $C_6$ of the saccharide ring may be particularly advantageous. Further suitable cobuilders are oxydisuccinates and other derivatives of disuccinates, preferably ethylenediamine disuccinate. Particular preference is given in this context as well to glycerol disuccinates and glycerol trisuccinates, as described for example in the U.S. Pat. Nos. 4,524,009, 4,639,325, in the European patent application EP 0150930 A1 and in the Japanese patent application JP 93/339896. Suitable use amounts in formulations containing zeolite and/or silicate are from 3 to 15% by weight. Further organic cobuilders which can be used are, for example, acetylated hydroxycarboxylic acids and/or their salts, which may also be present, where appropriate, in lactone form and which contain at least 4 carbon atoms and at least one hydroxyl group and also not more than two acid groups. Cobuilders of this kind are described, for example, in the international patent application WO 95/20029.

Suitable polymeric polycarboxylates are, for example, the sodium salts of polyacrylic acid or of polymethacrylic acid, examples being those having a relative molecular mass of from 800 to 150000 (based on acid and in each case measured against polystyrenesulfonic acid). Particularly suitable copolymeric polycarboxylates are those of acrylic acid with methacrylic acid and of acrylic acid or methacrylic acid with maleic acid. Copolymers of acrylic acid with maleic acid, containing from 50 to 90% by weight acrylic acid and from 50 to 10% by weight maleic acid, have proven particularly suitable. Their relative molecular mass, based on free acids, is generally from 5000 to 200000, preferably from 10000 to 120000, and in particular from 50000 to 100000 (measured in each case against polystyrenesulfonic acid). The (co)polymeric polycarboxylates may be used either as powders or in the form of an aqueous solution, in which case preference is given to aqueous solutions with a strength of from 20 to 55% by weight. Granular polymers are generally admixed subsequently to one or more base granules. Particular preference is also given to biodegradable polymers made up of more than two different monomer units, examples being those in accordance with DE 4300772 A1, containing as monomers salts of acrylic acid and of maleic acid and also vinyl alcohol and/or vinyl alcohol derivatives, or those in accordance with DE 4221381 C2, containing as monomers salts of acrylic acid and of 2-alkylallylsulfonic acid and also sugar derivatives. Preferred also as copolymers are those which are described in the German patent applications DE 4303320 A1 and DE 4417734 A1 and whose monomers comprise preferably acrolein and acrylic acid/acrylic acid salts or acrolein and vinyl acetate. Further preferred builder substances include polymeric amino dicarboxylic acids, their salts or their precursors. Particular preference is given to polyaspartic acids and their salts and derivatives.

Further suitable builder substances are polyacetals, which may be obtained by reacting dialdehydes with polyolcarboxylic acids having from 5 to 7 carbon atoms and at least 3 hydroxyl groups, as described for example in the European patent application EP 0280223 A1. Preferred polyacetals are obtained from dialdehydes such as glyoxal, glutaraldehyde, terephthalaldehyde and mixtures thereof and from polyolcarboxylic acids such as gluconic acid and/or glucoheptonic acid.

Fat- and Oil-detaching Substances

In addition, the compositions may also comprise components which have a positive influence on the ease with which oil and fat are washed off from textiles. The preferred oil- and fat-detaching components include, for example, nonionic cellulose ethers such as methylcellulose and methylhydroxypropylcellulose having a methoxy group content of from 15 to 30% by weight and a hydroxypropoxy group content of from 1 to 15% by weight, based in each case on the nonionic cellulose ether, and also the prior art polymers of phthalic acid and/or of terephthalic acid and/or of derivatives thereof, especially polymers of ethylene terephthalates and/or polyethylene glycol terephthalates, or anionically and/or nonionically modified derivatives thereof. Of these, particular preference is given to the sulfonated derivatives of the phthalic acid polymers and of the terephthalic acid polymers.

Bleaches and Bleach Activators

Among the compounds used as bleaches which yield $H_2O_2$ in water, particular importance is possessed by sodium perborate tetrahydrate and sodium perborate monohydrate. Further bleaches which may be used are, for example, sodium percarbonate, peroxypyrophosphates, citrate perhydrates, and $H_2O_2$-donating peracidic salts or peracids, such as perbenzoates, peroxophthalates, diperazelaic acid, phthaliminoperoxy acid or diperdodecanedioic acid. The bleach content of the compositions is preferably from 5 to 35% by weight and in particular up to 30% by weight, use being made advantageously of perborate monohydrate or percarbonate.

Bleach activators which may be used are compounds which under perhydrolysis conditions give rise to aliphatic peroxocarboxylic acids having preferably from 1 to 10 carbon atoms, in particular from 2 to 4 carbon atoms, and/or unsubstituted or substituted perbenzoic acid. Suitable substances are those which carry O-acyl and/or N-acyl groups of the stated number of carbon atoms, and/or substituted or unsubstituted benzoyl groups. Preference is given to polyacylated alkylenediamines, especially tetraacetylethylenediamine (TAED), acylated triazine derivatives, especially 1,5-diacetyl-2,4-dioxohexahydro-1,3,5-triazine (DADHT), acylated glycolurils, especially tetraacetylglycoluril (TAGU), N-acyl imides, especially N-nonanoylsuccinimide (NOSI), acylated phenolsulfonates, especially n-nonanoyl- or isononanoyloxybenzenesulfonate (n- or iso-NOBS), carboxylic anhydrides, especially phthalic anhydride, acylated polyhydric alcohols, especially triacetin, ethylene glycol diacetate, 2,5-diacetoxy-2,5-dihydrofuran, and the enol esters known from the German patent applications DE 19616693 A1 and DE 19616767 A1, and also acetylated sorbitol and mannitol and/or mixtures thereof (SORMAN) described in the European patent application EP 0525239 A1, acylated sugar derivatives, especially pentaacetylglucose (PAG), pentaacetylfructose, tetraacetylxylose and octaacetyllactose, and also acetylated, optionally N-alkylated glucamine and gluconolactone, and/or N-acylated lactams, an example being N-benzoyl caprolactam, which are known from the international patent applications WO 94/27970, WO 94/28012, WO 94/28103, WO 95/00626, WO 95/14759 and WO 95/17498. The hydrophilically substituted acyl acetals known from the German patent application DE 19616769 A1 and the acyl lactams described in the German patent application DE 19616770 and also in the international patent application WO 95/14075 are likewise used with preference. It is also possible to use the combinations of conventional bleach activators known from the German patent application DE 4443177 A1. Bleach activators of this kind are present in the customary quantity range, preferably in amounts of from 1% by weight to 10% by weight, in particular from 2% by weight to 8% by weight, based on overall composition. In addition to the abovementioned conventional bleach activators, or instead of them, it is also possible for the bleach-boosting transition metal salts and/or transition metal complexes and/or sulfone imines known from the European patents EP 0446982 B1 and EP 0453003 B1 to be present as so-called bleaching catalysts. The transition metal compounds in question include in particular those manganese, iron, cobalt, ruthenium or molybdenum salen complexes known from the German patent application DE 19529905 A1, and their N-analog compounds known from the German patent application DE 19620267 A1; the manganese, iron, cobalt, ruthenium or molybdenum carbonyl complexes known from the German patent application DE 19536082 A1; the manganese, iron, cobalt, ruthenium, molybdenum, titanium, vanadium and copper complexes with nitrogen-containing tripod ligands that are described in the German patent application DE 19605688 A1; the cobalt, iron, copper and ruthenium amine complexes known from the German patent application DE 19620411 A1; the manganese, copper and cobalt complexes described in the German patent application DE 4416438 A1; the cobalt complexes described in the European patent application EP 0272030 A1; the manganese complexes known from the European patent application EP 0693550 A1; the manganese, iron, cobalt and copper complexes known from the European patent EP 0392592 A1; and/or the manganese complexes described in the European patent EP 0443651 B1 or in the European patent applications EP 0458397 A1, EP 0458398 A1, EP 0549271 A1, EP 0549272 A1, EP 0544490 A1 and EP 0544519 A1. Combinations of bleach activators and transition metal bleaching catalysts are known, for example, from the German patent application DE 19613103 A1 and from the international patent application WO 95/27775. Bleach-boosting transition metal complexes, especially those with the central atoms Mn, Fe, Co, Cu, Mo, V, Ti and/or Ru, are employed in customary amounts, preferably in an amount of up to 1% by weight, in particular from 0.0025% by weight to 0.25% by weight, and with particular preference from 0.01% by weight to 0.1% by weight, based in each case on overall composition.

Enzymes and Enzyme Stabilizers

Particularly suitable enzymes include those from the class of the hydrolases, such as the proteases, esterases, lipases or lipolytic enzymes, amylases, cellulases or other glycosyl hydrolases, and mixtures of the stated enzymes. All of these hydrolases contribute in the wash to removing stains, such as proteinaceous, fatty or starchy stains, and instances of graying. Cellulases and other glycosyl hydrolases may, by removing pilling and microfibrils, make a contribution to color retention and to enhancing the softness of the textile. For bleaching and/or for inhibiting dye transfer it is also possible to use oxidoreductases. Especially suitable active enzymatic substances are those obtained from bacterial strains or fungi, such as *Bacillus subtilis, Bacillus licheniformis, Streptomyces griseus* and *Humicola insolens.* It is preferred to use proteases of the subtilisin type, and especially proteases obtained from *Bacillus lentus.* Of particular interest in this context are enzyme mixtures, examples being those of protease and amylase or protease and lipase or lipolytic enzymes, or protease and cellulase, or of cellulase and lipase or lipolytic enzymes, or of protease, amylase and lipase or lipolytic enzymes, or protease, lipase or lipolytic enzymes and cellulase, but especially mixtures containing protease and/or lipase, or mixtures containing lipolytic enzymes. Examples of such lipolytic enzymes are the known cutinases. Peroxidases or oxidases have also proven suitable in some cases. The suitable amylases include, in particular, α-amylases, isoamylases, pullulanases, and pectinases. Cellulases used are preferably cellobiohydrolases, endoglucanases and β-glucosidases, also referred to as cellobiases, and mixtures of these. Since the different cellulase types differ in their CMCase and Avicelase activities, the desired activities may be established by means of particular mixtures of the cellulases.

The enzymes may be adsorbed on carrier substances and/or embedded in coating substances in order to protect them against premature decomposition. The fraction of the enzymes, enzyme mixtures or enzyme granules may be, for example, from about 0.1 to 5% by weight, preferably from 0.1 to about 2% by weight. In addition to the monofunctional and polyfunctional alcohols, the compositions may comprise further enzyme stabilizers. For example, from 0.5 to 1% by weight of sodium formate may be used. Also possible is the use of proteases stabilized with soluble calcium salts, with a calcium content of preferably about 1.2% by weight, based on the enzyme. Besides calcium salts, magnesium salts also serve as stabilizers. However, it is particularly advantageous to employ boron compounds, examples being boric acid, boron oxide, borax and other alkali metal borates such as the salts of orthoboric acid ($H_3BO_3$), of metaboric acid ($HBO_2$), and of pyroboric acid (tetraboric acid, $H_2B_4O_7$).

Graying Inhibitors

Graying inhibitors (antiredeposition agents) have the function of keeping the soil detached from the fiber in suspension in the liquor and so preventing the reattachment (redeposition) of the soil. Suitable for this purpose are water-soluble colloids, usually organic in nature, examples being the water-soluble salts of polymeric carboxylic acids, glue, gelatin, salts of ether carboxylic acids or ether sulfonic acids of starch or of cellulose, or salts of acidic sulfuric esters of cellulose or of starch. Water-soluble polyamides containing acidic groups are also suitable for this purpose. Furthermore, use may be made of soluble starch preparations and starch products other than those mentioned above, examples being degraded starch, aldehyde starches, etc. Polyvinylpyrrolidone as well can be used. However, it is preferred to use celluose ethers, such as carboxymethylcellulose (Na salt), methylcellulose, hydroxyalkylcellulose, and mixed ethers, such as methylhydroxyethylcellulose, methylhydroxypropylcellulose, methylcarboxymethylcellulose and mixtures thereof, and also polyvinylpyrrolidone, for example, in amounts of from 0.1 to 5% by weight, based on the compositions.

Optical Brighteners

As optical brighteners the compositions may comprise derivatives of diaminostilbenedisulfonic acid and/or alkali metal salts thereof. Suitable, for example, are salts of 4,4'-bis(2-anilino-4-morpholino-1,3,5-triazinyl-6-amino) stilbene-2,2'-disulfonic acid or compounds of similar structure which instead of the morpholino group carry a diethanolamino group, a methylamino group, an anilino group, or a 2-methoxyethylamino group. It is possible for brighteners of the substituted diphenylstyryl type to be present, examples being the alkali metal salts of 4,4'-bis(2-sulfostyryl)biphenyl, 4,4'-bis(4-chloro-3-sulfostyryl)-biphenyl or 4-(4-chlorostyryl)-4'-(2-sulfostyryl)biphenyl. Mixtures of the aforementioned brighteners may also be used. Uniformly white granules are obtained if, in addition to the customary brighteners in customary amounts, examples being between 0.1 and 0.5% by weight, preferably between 0.1 and 0.3% by weight, the compositions also include small amounts, examples being from $10^{-6}$ to $10^{-3}$% by weight, preferably around $10^{-5}$% by weight, of a blue dye. One particularly preferred dye is TINOLUX® (commercial product from Ciba-Geigy).

Polymers

Suitable dirt-repelling polymers (soil repellents) include those substances which preferably contain ethylene terephthalate and/or polyethylene glycol terephthalate groups, it being possible for the molar ratio of ethylene terephthalate to polyethylene glycol terephthalate to be situated within the range from 50:50 to 90:10. The molecular weight of the linking polyethylene glycol units is situated in particular in the range from 750 to 5000, i.e., the degree of ethoxylation of the polymers containing polyethylene glycol groups can be from about 15 to 100. The polymers feature an average molecular weight of about 5000 to 200000 and may have a block structure, though preferably have a random structure. Preferred polymers are those having ethylene terephthalate/polyethylene glycol terephthalate molar ratios of from about 65:35 to about 90:10, preferably from about 70:30 to 80:20. Preference is also given to those polymers which have linking polyethylene glycol units with a molecular weight of from 750 to 5000, preferably from 1000 to about 3000, and with a molecular weight of the polymer of from about 10000 to about 50000. Examples of commercial polymers are the products MILEASE® T (ICI) or REPELOTEX® SRP 3 (Rhône-Poulenc).

Defoamers

As defoamers it is possible to use waxlike compounds. "Waxlike" compounds are those whose melting point at atmospheric pressure is more than 25° C. (room temperature), preferably more than 50° C., and in particular more than 70° C. The waxlike defoamer substances are virtually insoluble in water; that is, at 20° C. they have a solubility in 100 g of water of below 0.1% by weight. In principle, any of the waxlike defoamer substances known from the prior art may be included. Examples of suitable waxlike compounds are bisamides, fatty alcohols, fatty acids, carboxylic acid esters of monohydric and polyhydric alcohols, and also paraffin waxes, or mixtures thereof. An alternative possibility is of course to use the silicone compounds which are known for this purpose.

Suitable paraffin waxes generally constitute a complex substance mixture without a defined melting point. The mixture is normally characterized by determining its melting range using differential thermal analysis (DTA), as described in The Analyst 87 (1962), 420, and/or its solidification point. The solidification point is the temperature at which the paraffin, by slow cooling, undergoes transition from the liquid to the solid state. Paraffins which are completely liquid at room temperature, i.e., those having a solidification point below 25° C., cannot be used in accordance with the invention. The soft waxes, those having a melting point in the range from 35 to 50° C., include preferably the group of the petrolatums and their hydrogenation products. They are composed of microcrystalline paraffins and up to 70% by weight of oil, possess an ointmentlike to plastically solid consistency, and constitute bitumen-free residues from petroleum processing. Particular preference is given to distillation residues (petrolatum stock) of certain paraffin-base and mixed-base crude oils, which are processed further into Vaseline. Such products further comprise bitumen-free, oleaginous to solid hydrocarbons deposited by means of solvents from distillation residues of paraffin- and mixed-base crude oils and cylinder oil distillates. They are of semisolid, viscous, tacky or plastically solid consistency and possess melting points of between 50 and 70° C. These petrolatums constitute the major starting point for the preparation of micro waxes. Also suitable are the solid hydrocarbons, with melting points between 63 and 79° C., which are deposited from high-viscosity, paraffin-containing lubricating oil distillates in the course of dewaxing. These petrolatums comprise mixtures of microcrystalline waxes and high-melting n-paraffins. It is possible to use, for example, the paraffin wax mixtures known from EP 0309931 A1, made up for example of from 26% by weight to 49% by weight of microcrystalline paraffin wax having a solidification point of from 62° C. to 90° C., from 20% by weight to 49% by weight of hard paraffin with a solidification point of from 42° C. to 56° C., and from 2% by weight to 25% by weight of soft paraffin having a solidification point of from 35° C. to 40° C. It is preferred to use paraffins or paraffin mixtures which solidify in the range from 30° C. to 90° C. It needs to be borne in mind here that even paraffin wax mixtures which appear solid at room temperature may include various fractions of liquid paraffin. In the case of the paraffin waxes suitable for use in accordance with the invention, this liquid fraction is as low as possible and is preferably absent entirely.

Accordingly, particularly preferred paraffin wax mixtures have a liquid fraction at 30° C. of less than 10% by weight, in particular from 2% by weight to 5% by weight, a liquid fraction at 40° C. of less than 30% by weight, preferably from 5% by weight to 25% by weight, and in particular from 5% by weight to 15% by weight, a liquid fraction at 60° C. of from 30% by weight to 60% by weight, in particular from 40% by weight to 55% by weight, a liquid fraction at 80° C. of from 80% by weight to 100% by weight, and a liquid fraction at 90° C. of 100% by weight. In the case of particularly preferred paraffin wax mixtures, the temperature at which a liquid fraction of 100% by weight of the paraffin wax is attained is still below 85° C., in particular at from 75° C. to 82° C. The paraffin waxes may comprise petrolatum, microcrystalline waxes, and hydrogenated or partially hydrogenated paraffin waxes.

Appropriate bisamide defoamers are those deriving from saturated fatty acids having from 12 to 22, preferably from 14 to 18 carbon atoms, and from alkylenediamines having from 2 to 7 carbon atoms. Suitable fatty acids are lauric, myristic, stearic, arachic and behenic acid and mixtures thereof, such as are obtainable from natural fats and/or hydrogenated oils, such as tallow or hydrogenated palm oil. Examples of suitable diamines are ethylenediamine, 1,3-propylenediamine, tetramethylenediamine, pentamethylenediamine, hexamethylenediamine, p-phenylenediamine, and tolylenediamine. Preferred diamines are ethylenediamine and hexamethylenediamine. Particularly preferred bisamides are bismyristoylethylenediamine, bispalmitoylethylenediamine, bisstearoylethylenediamine, and mixtures thereof, and also the corresponding derivatives of hexamethylenediamine.

Suitable carboxylic ester defoamers derive from carboxylic acids having from 12 to 28 carbon atoms. The esters in question particularly include those of behenic acid, stearic acid, hydroxystearic acid, oleic acid, palmitic acid, myristic acid and/or lauric acid. The alcohol moiety of the carboxylic ester comprises a monohydric or polyhydric alcohol having from 1 to 28 carbon atoms in the hydrocarbon chain. Examples of suitable alcohols are behenyl alcohol, arachidyl alcohol, cocoyl alcohol, 12-hydroxystearyl alcohol, oleyl alcohol, and lauryl alcohol, and also ethylene glycol, glycerol, polyvinyl alcohol, sucrose, erythritol, pentaerythritol, sorbitan and/or sorbitol. Preferred esters are those of ethylene glycol, glycerol, and sorbitan, the acid moiety of the ester being selected in particular from behenic acid, stearic acid, oleic acid, palmitic acid or myristic acid. Suitable esters of polyhydric alcohols are, for example, xylitol monopalmitate, pentaerythritol monostearate, glycerol monostearate, ethylene glycol monostearate, and sorbitan monostearate, sorbitan palmitate, sorbitan monolaurate, sorbitan dilaurate, sorbitan distearate, sorbitan dibehenate, sorbitan dioleate, and also mixed tallow alkyl sorbitan monoesters and diesters. Glycerol esters which can be used are the mono-, di- or triesters of glycerol and the carboxylic acids mentioned, with the monoesters or diesters being preferred. Glycerol monostearate, glycerol monooleate, glycerol monopalmitate, glycerol monobehenate, and glycerol distearate are examples thereof. Examples of suitable natural ester defoamers are beeswax, which consists principally of the esters $CH_3(CH_2)_{24}COO(CH_2)_{27}CH_3$ and $CH_3(CH_2)_{26}COO(CH_2)_{25}CH_3$, and carnauba wax, which is a mixture of carnaubic acid alkyl esters, often in combination with small fractions of free carnaubic acid, further long-chain acids, high molecular mass alcohols and hydrocarbons.

Suitable carboxylic acids as further defoamer compounds are particularly behenic acid, stearic acid, oleic acid, palmitic acid, myristic acid, and lauric acid, and also mixtures thereof, such as are obtainable from natural fats and/or optionally hydrogenated oils, such as tallow or hydrogenated palm oil. Preference is given to saturated fatty acids having from 12 to 22, in particular from 18 to 22, carbon atoms. Similarly, the corresponding fatty alcohols of the same carbon chain length may be used.

Furthermore, dialkyl ethers may additionally be present as defoamers. The ethers may be asymmetrical or else symmetrical in composition, i.e., contain two identical or different alkyl chains, preferably with from 8 to 18 carbon atoms. Typical examples are di-n-octyl ether, diisooctyl ether and di-n-stearyl ether; particularly suitable are dialkyl ethers having a melting point of more than 25° C., in particular more than 40° C.

Further suitable defoamer compounds are fatty ketones, which may be obtained by the relevant methods of preparative organic chemistry. They are prepared, for example, starting from carboxylic acid magnesium salts, which are pyrolyzed at temperatures above 300° C. with elimination of carbon dioxide and water, in accordance for example with the German laid-open specification DE 2553900 A. Suitable fatty ketones are those prepared by pyrolyzing the magnesium salts of lauric acid, myristic acid, palmitic acid, palmitoleic acid, stearic acid, oleic acid, elaidic acid, petroselinic acid, arachic acid, gadoleic acid, behenic acid or erucic acid.

Further suitable defoamers are fatty acid polyethylene glycol esters, which are obtained preferably by homogeneous base-catalyzed addition reaction of ethylene oxide with fatty acids. In particular, the addition reaction of ethylene oxide with the fatty acids takes place in the presence of alkanolamine catalysts. The use of alkanolamines, especially triethanolamine, leads to extremely selective ethoxylation of the fatty acids, especially where the aim is to prepare compounds with low degrees of ethoxylation. Within the group of the fatty acid polyethylene glycol esters, preference is given to those having a melting point of more than 25° C., in particular more than 40° C.

Within the group of the waxlike defoamers, particular preference is given to using the above-described paraffin waxes as sole waxlike defoamers or in a mixture with one of the other waxlike defoamers, the fraction of the paraffin waxes in the mixture accounting preferably for more than 50% by weight, based on the waxlike defoamer mixture. Where appropriate, the paraffin waxes may have been applied to carriers. Suitable carrier materials include all known inorganic and/or organic carrier materials. Examples of typical inorganic carrier materials are alkali metal carbonates, aluminosilicates, water-soluble phyllosilicates, alkali metal silicates, alkali metal sulfates, an example being sodium sulfate, and alkali metal phosphates. The alkali metal silicates preferably comprise a compound having an alkali metal oxide to $SiO_2$ molar ratio of from 1:1.5 to 1:3.5. The use of such silicates results in especially good particle properties; in particular, high abrasion stability and yet high dissolution rate in water. The aluminosilicates referred to as carrier materials include in particular the zeolites, examples being zeolite NaA and NaX. The compounds referred to as water-soluble phyllosilicates include, for example, amorphous or crystalline waterglass. It is also possible to use silicates which are in commerce under the designation AEROSIL® or SIPERNAT®. As organic carrier materials, suitable examples include film-forming polymers, examples being polyvinyl alcohols, polyvinylpyrrolidones, poly (meth)acrylates, polycarbonates, cellulose derivatives, and starch. Cellulose ethers that may be used are, in particular, alkali metal carboxymethylcellulose, methylcellulose, ethylcellulose, hydroxyethylcellulose, and what are known as cellulose mixed ethers, examples being methylhydroxyethylcellulose and methylhydroxypropylcellulose, and also mixtures thereof. Particularly suitable mixtures are composed of sodium carboxymethylcellulose and methylcellulose, the carboxymethylcellulose usually having a degree of substitution of from 0.5 to 0.8 carboxymethyl groups per anhydroglucose unit and the methylcellulose having a degree of substitution of from 1.2 to 2 methyl groups per anhydroglucose unit. The mixtures preferably comprise alkali metal carboxymethylcellulose and nonionic cellulose ethers in weight proportions of from 80:20 to 40:60, in particular from 75:25 to 50:50. Another suitable carrier is natural starch, which is composed of amylose and amylopectin. Natural starch is starch such as is available as an extract from natural sources, for example, from rice, potatoes, corn, and wheat. Natural starch is a commercially customary product and as such is readily available. As carrier materials it is possible to use one or more of the compounds mentioned above, selected in particular from the group of the alkali metal carbonates, alkali metal sulfates, alkali metal phosphates, zeolites, water-soluble phyllosilicates, alkali metal silicates, polycarboxylates, cellulose ethers, polyacrylate/polymethacrylate, and starch. Particularly suitable mixtures are those of alkali metal carbonates, especially sodium carbonate, alkali metal silicates, especially sodium silicate, alkali metal sulfates, especially sodium sulfate, and zeolites.

Suitable silicones are customary organopolysiloxanes which may contain finely divided silica, which in turn may also have been silanized. Such organopolysiloxanes are described, for example, in the European patent application EP 0496510 A1. Particularly preferred polydiorganosiloxanes and especially polydimethylsiloxanes are those which are known from the prior art. Suitable polydiorganosiloxanes have a virtually linear chain and a degree of oligomerization of from 40 to 1500. Examples of suitable substituents are methyl, ethyl, propyl, isobutyl, tert-butyl and phenyl. Also suitable are amino-, fatty acid-, alcohol-, polyether-, epoxy-, fluoro-, glycoside- and/or alkyl-modified silicone compounds, which at ambient temperature may be present in either liquid or resin form. Suitability extends to simethicones, which are mixtures of dimethicones having an average chain length of from 200 to 300 dimethylsiloxane units and hydrogenated silicates. As a general rule, the silicones in general and the polydiorganosiloxanes in particular include finely divided silica, which may also have been silanized. Particularly suitable in the context of the present invention are silica-containing dimethylpolysiloxanes. Advantageously, the polydiorganosiloxanes have a Brookfield viscosity at 25° C. (spindle 1, 10 rpm) in the range from 5000 mPas to 30000 mPas, in particular from 15000 to 25000 mPas. The silicones are used preferably in the form of their aqueous emulsions. In general, the silicone is added with stirring to the initial water charge. If desired, the viscosity may be increased by adding thickeners, such as are known from the prior art, to the aqueous silicone emulsions. These thickeners may be organic and/or inorganic in nature; particular preference is given to nonionic cellulose ethers such as methylcellulose, ethylcellulose, and mixed ethers such as methylhydroxyethylcellulose, methylhydroxypropylcellulose, methylhydroxybutylcellulose, and also anionic carboxycellulose types such as sodium carboxymethylcellulose (CMC). Particularly suitable thickeners are mixtures of CMC to nonionic cellulose ethers in a weight ratio from 80:20 to 40:60, in particular from 75:25 to 60:40. In general, and especially when the thickener mixtures described are added, advisable use concentrations are from about 0.5 to 10%, in particular from 2.0 to 6% by weight, calculated as thickener mixture and based on aqueous silicone emulsion. The amount of silicones of the type described in the aqueous emulsions is advantageously in the range from 5 to 50% by weight, in particular from 20 to 40% by weight, calculated as silicones and based on aqueous silicone emulsion. In a further advantageous embodiment, the aqueous silicone solutions receive, as a thickener, starch obtainable from natural sources, such as from rice, potatoes, corn and wheat, for example. The starch is present advantageously in amounts of from 0.1 up to 50% by weight, based on silicone emulsion, and in particular is in a mixture with the above-described thickener mixtures of sodium carboxymethylcellulose and a nonionic cellulose ether in the amounts already specified. To prepare the aqueous silicone emulsions an appropriate procedure is to subject any thickeners present to preswelling in water before adding the silicones. The silicones are appropriately incorporated with the aid of effective stirring and mixing devices.

Disintegrants

The solid formulations may further comprise disintegrants. These are substances which are added to the tablets in order to accelerate their breakdown when they are brought into contact with water. Overviews of this subject can be found, for example, in J. Pharm. Sci. 61 (1972), Römpp Chemilexikon, 9th edition, volume 6, p. 4440, and Voigt "*Lehrbuch der pharmazeutischen Technologie*" (6th edition, 1987, pp. 182–184). These substances increase in volume on ingress of water, with on the one hand an increase in the intrinsic volume (swelling) and on the other hand, by way of the release of gases, the generation of a pressure which causes the tablets to disintegrate into smaller particles. Examples of established disintegration aids are carbonate/citric acid systems, with the use of other organic acids also being possible. Examples of swelling disintegration aids are synthetic polymers such as uncrosslinked or crosslinked polyvinylpyrrolidone (PVP) or natural polymers and/or modified natural substances such as cellulose and starch and their derivatives, alginates or casein derivatives. Preferred disintegrants used in the context of the present invention are cellulose-based disintegrants. Pure cellulose has the formal empirical composition $(C_6H_{10}O_5)_n$ and, considered formally, is a β-1,4-polyacetal of cellobiose, which itself is constructed of two molecules of glucose. Suitable celluloses consist of from about 500 to 5000 glucose units and, accordingly, have average molecular masses of from 50000 to 500000. Cellulose-based disintegrants which can be used also include, in the context of the present invention, cellulose derivatives obtainable from cellulose by polymer-analogous reactions. Such chemically modified celluloses include, for example, products of esterifications and etherifications in which hydroxy hydrogen atoms have been substituted. However, celluloses in which the hydroxyl groups have been replaced by functional groups not attached via an oxygen atom may also be used as cellulose derivatives. The group of the cellulose derivatives also embraces, for example, alkali metal celluloses, carboxymethylcellulose (CMC), cellulose esters and cellulose ethers, and aminocelluloses. Said cellulose derivatives are preferably not used alone as cellulose-based disintegrants but instead are used in a mixture with cellulose. The cellulose derivative content of these mixtures is preferably less than 50% by weight, with particular preference less than 20% by weight, based on the cellulose-based disintegrant. A particularly preferred cellulose-based disintegrant used is pure cellulose, free from cellulose derivatives. As a further cellulose-based disintegrant or as a constituent of this component it is possible to use microcrystalline cellulose. This microcrystalline cellulose is obtained by partial hydrolysis of celluloses under conditions which attack only the amorphous regions (approximately 30% of the total cellulose mass) of the celluloses and break them up completely but leave the crystalline regions (approximately 70%) intact. Subsequent deaggregation of the microfine celluloses resulting from the hydrolysis yields the microcrystalline celluloses, which have primary particle sizes of approximately 5 $\mu$m and may be compacted, for example, to granules having an average particle size of 200 $\mu$m. Within the tablet, viewed macroscopically, the disintegrants may be present in a homogeneously distributed form; viewed microscopically, however, the preparation process results in them forming zones of increased concentration. Disintegrants which may be present in the context of the invention, such as Kollidon, alginic acid and the alkali metal salts thereof, amorphous or else partly crystalline phyllosilicates (bentonites), polyacrylates, and polyethylene glycols, can be found, for example, in the documents WO 98/40462 (Rettenmaier), WO 98/55583 and WO 98/55590 (Unilever), and WO 98/40463, DE 19709991 and DE 19710254 (Henkel) The teaching of these documents is expressly incorporated by reference. The tablets may comprise the disintegrants in amounts of from 0.1 to 25%, preferably from 1 to 20%, and in particular from 5 to 15% by weight, based on the tablets.

Fragrances

As perfume oils and/or fragrances it is possible to use certain odorant compounds, examples being the synthetic products of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate, and benzyl salicylate. The ethers include, for example, benzyl ethyl ether; the aldehydes include, for example, the linear alkanals having 8-18 carbon atoms, citral, citronellal, citronellyloxyacetaldehyde, cylamen aldehyde, hydroxycitronellal, lilial, and bourgeonal; the ketones include, for example, the ionones, $\alpha$-isomethylionone and methyl cedryl ketone; the alcohols include anethole, citronellol, eugenol, geraniol, linalool, phenylethyl alcohol and terpineol; and the hydrocarbons include primarily the terpenes such as limonene and pinene. Preference, however, is given to the use of mixtures of different odorants, which together produce an appealing fragrance note. Such perfume oils may also contain natural odorant mixtures, such as are obtainable from plant sources, examples being pine oil, citrus oil, jasmine oil, patchouli oil, rose oil or ylang-ylang oil. Likewise suitable are muscatel, sage oil, camomile oil, clove oil, balm oil, mint oil, cinnamon leaf oil, lime blossom oil, juniperberry oil, vetiver oil, olibanum oil, galbanum oil, and labdanum oil, and also orange blossom oil, nerol oil, orangepeel oil, and sandalwood oil.

The fragrances may be incorporated directly into the compositions of the invention; alternatively, it may be advantageous to apply the fragrances to carriers which intensify the adhesion of the perfume on the laundry and, by means of slower fragrance release, ensure longlasting fragrance of the textiles. Materials which have become established as such carriers are, for example, cyclodextrins, it being possible in addition for the cyclodextrin-perfume complexes to be further coated with other auxiliaries.

Inorganic Salts

Further suitable ingredients of the compositions are water-soluble inorganic salts such as bicarbonates, carbonates, amorphous silicates, standard waterglasses, which have no outstanding builder properties, or mixtures of these; use is made in particular of alkali metal carbonate and/or amorphous alkali metal silicate, especially sodium silicate having an $Na_2O:SiO_2$ molar ratio of from 1:1 to 1:4.5, preferably from 1:2 to 1:3.5. The sodium carbonate content of the end formulations is preferably up to 40% by weight, advantageously between 2 and 35% by weight. The sodium silicate (without particular builder properties) content of the compositions is generally up to 10% by weight and preferably between 1 and 8% by weight. In addition, as make-up or standardizing agent, sodium sulfate, for example, may be present in amounts of from 0 to 10%, particularly from 1 to 5%, by weight, based on the composition.

EXAMPLES

Initial Preparation

Preparation of the formulations in powder form takes place by applying the liquids (fatty alcohol/alkyl and/or alkenyl oligoglycoside) to solid builder substances in a L ödige mixer. TAED and perborate, however, are mixed in only after the liquids have been applied.

The mixture is divided by a sample divider into sample quantities of 75 g. (75 g corresponds to the dose for one wash cycle)

To determine the wash performance, test fabrics from the Krefeld Laundry Research Institute (WFK), Krefeld, Germany, with different types of soiling are used (table 1). 2 each of the test fabrics are attached to a towel.

TABLE 1

| | Soiling/fabric |
|---|---|
| Washable | |
| wfk 10 D | wfk soil/sebum on cotton |
| wfk 20 D | wfk soil/sebum on polyester/cotton |
| wfk 30 D | wfk soil/sebum on polyester |
| wfk 10 C | wfk soil/lanolin on cotton |
| wfk 20 D | wfk soil/lanolin on polyester/cotton |
| WFK 30 C | wfk soil/lanolin on polyester |
| Cosmetics | |
| wfk 10 LS | Lipstick/15.5 g/m$^2$ on cotton |
| wfk 20 LS | Lipstick/15.5 g/m$^2$ on polyester/cotton |
| wfk 10 MU | Makeup on cotton |
| wfk 20 MU | Makeup on polyester/cotton |

Test Conditions

The test fabric and 3.5 kg of clean ballast laundry are washed using a Miele W 918 in the coloreds wash program at 30 and 60° C., with addition of 75 g/ of powder per wash cycle. A total water volume of 17 l was produced by metering in water (water hardness 16° d [German hardness]) via a water meter to the amount of water pumped into the machine automatically.

The laundering result of the laundry detergents of the invention was determined on the basis of 3-fold measurement in different machines of the same type.

Evaluation

After the wash cycle has run, the specimens are removed from the carrier cloth and passed through a mangle.

The reflectance of the fabric is measured using a Minolta Cromameter in Y xy mode. In this way, two measurements (swatches 1+2) were first generated for each cycle and each fabric; the resulting average corresponds to the result of a single measurement. Three of these single measurements were averaged to give the end result (see table 3).

Table 2 below compares the formulations of two comparative tests (C1 and C2) with an inventive formulation (B). All figures should be understood as being % by weight and have been calculated as active substance.

TABLE 2

| Formulation | C 1 | C 2 | B |
|---|---|---|---|
| Dehydol LT 7 | 7.5 | 7.5 | 7.5 |
| Glucopon 600 CS UP* | 10 | — | — |
| Glucopon 50 G** | — | 10 | — |
| APG FA-containing*** | — | — | 5.6 |
| Fatty alcohol content of APG | — | — | 0.6 |
| STPP | 33 | 33 | 33 |
| Sodium carbonate | 20 | 20 | 20 |
| CMC | 2 | 2 | 2 |
| Na perborate 4 water | 18 | 18 | 18 |
| TAED | 3 | 3 | 3 |
| Na sulfate | ad 100 | ad 100 | ad 100 |

*50% strength aqueous solution of APG 1214
**50%-content APG granules (sulfate, water-glass to 100%)
***88%-content, anhydrous APG with 12% FA 12/14

TABLE 3

| | Wash result 60° C. % reflectance | | | | | Wash result 30° C. % reflectance | | | | |
|---|---|---|---|---|---|---|---|---|---|---|
| | C1 | C2 | B | Δ* | Δ+ | C1 | C2 | B | Δ* | Δ+ |
| WFK 20 C | 81.8 | 81.6 | 82.6 | 1.0 | 1.2 | 51.7 | 52.1 | 56.5 | 9.3 | 8.4 |
| WFK 30 C | 72.5 | 72.9 | 74.3 | 2.5 | 1.9 | 62.0 | 64.0 | 68.4 | 10.3 | 6.9 |
| WFK 10 D | 81.0 | 80.9 | 82.1 | 1.4 | 1.5 | 75.0 | 71.7 | 75.6 | 0.8 | 5.4 |
| WFK 20 D | 84.9 | 84.7 | 84.6 | — | — | 81.5 | 82.0 | 83.4 | 2.3 | 1.7 |
| WFK 30 D | 80.3 | 79.5 | 80.1 | — | — | 76.6 | 76.9 | 78.9 | 3.0 | 2.6 |
| WFK 10 LS | 83.9 | 84.4 | 85.0 | 1.3 | 0.7 | 65.4 | 64.1 | 72.4 | 10.7 | 12.9 |
| WFK 20 LS | 84.5 | 84.4 | 84.7 | — | — | 69.7 | 70.6 | 78.4 | 12.5 | 11.0 |
| WFK 10 MU | 83.5 | 83.2 | 83.0 | — | — | 78.2 | 75.9 | 78.5 | 0.4 | 3.4 |
| WFK 20 MU | 84.3 | 84.1 | 84.1 | — | — | 81.9 | 81.5 | 83.3 | 1.7 | 1.8 |

Δ*: Improvement in wash performance (reflectance C1 to B) in %
Δ+: Improvement in wash performance (reflectance C2 to B) in %

Comparison of the wash results shows that the use of the inventive surfactant systems (B) provides an improved wash performance. Preference is given to the use of these surfactant systems in laundry detergents and cleaning products at a service temperature of 30° C. Improvements in wash performance of up to 12.9% are produced. The laundry detergents and cleaning products of the invention have a particularly advantageous effect in removing soiling/sebum and lanolin from cotton fabric and polyester fabric and the blend fabric. A distinct improvement in wash performance is evident, for example, on lipstick stains at washing temperatures of 30°.

What is claimed is:

1. A laundry detergent composition comprising a surfactant system containing:

(a) from about 1 to 15% by weight of an alkyl and/or alkenyl oligoglycoside;

(b) from about 5 to 35% by weight of a fatty alcohol; and (c) from about 0.1 to 1.5% by weight water, all weights being based on the weight of the surfactant system.

2. The composition of claim 1 wherein the alkyl and/or alkenyl oligoglycoside is based on hydrogenated $C_{12-14}$ cocoyl alcohol having a degree of polymerization of from about 1 to 3.

3. The composition of claim 1 wherein the fatty alcohol is a mixture of saturated and unsaturated fatty alcohols having an iodine number of from about 20 to 130.

4. The composition of claim 3 wherein the fatty alcohol has a conjugated ene content of about 4.5% by weight.

5. The composition of claim 1 wherein the fatty alcohol is present in the surfactant system in an amount of from about 8 to 32% by weight.

6. The composition of claim 1 wherein the fatty alcohol is present in the surfactant system in an amount of from about 11 to 25% by weight, based on the weight of the surfactant system.

7. The composition of claim 1 wherein the alkyl and/or alkenyl oligoglycoside is present in the composition in an amount of from about 2 to 10% by weight, based on the weight of the composition.

8. A process for effectively cleaning textiles at a wash temperature of from about 30 to 40° C. by washing the textiles with a laundry detergent composition comprising a surfactant system containing:

(a) from about 1 to 15% by weight of an alkyl and/or alkenyl oligoglycoside;

(b) from about 5 to 35% by weight of a fatty alcohol; and (c) up to 2% by weight water, all weights being based on the weight of the surfactant system.

9. The process of claim 8 wherein the alkyl and/or alkenyl oligoglycoside is based on hydrogenated $C_{12-14}$ cocoyl alcohol having a degree of polymerization of from about 1 to 3.

10. The process of claim 8 wherein the fatty alcohol is a mixture of saturated and unsaturated fatty alcohols having an iodine number of from about 20 to 130.

11. The process of claim 10 wherein the fatty alcohol has a conjugated ene content of less than about 4.5% by weight.

12. The process of claim 8 wherein the fatty alcohol is present in the surfactant system in an amount of from about 8 to 32% by weight.

13. The process of claim 8 wherein the fatty alcohol is present in the surfactant system in an amount of from about 11 to 25% by weight, based on the weight of the surfactant system.

14. The process of claim 8 wherein the alkyl and/or alkenyl oligoglycoside is present in the composition in an amount of from about 2 to 10% by weight, based on the weight of the composition.

* * * * *